US005244352A

United States Patent [19]

Mugele

[11] Patent Number: 5,244,352

[45] Date of Patent: Sep. 14, 1993

[54] MULTI-STAGE VACUUM PUMP INSTALLATION

[75] Inventor: Kurt-Willy Mugele, Erlangen, Fed. Rep. of Germany

[73] Assignee: Siemens Aktiengesellschaft, Munich, Fed. Rep. of Germany

[21] Appl. No.: 635,148

[22] PCT Filed: Jun. 12, 1989

[86] PCT No.: PCT/EP89/00659

§ 371 Date: Dec. 21, 1990

§ 102(e) Date: Dec. 21, 1990

[87] PCT Pub. No.: WO89/12751

PCT Pub. Date: Dec. 28, 1989

[30] Foreign Application Priority Data

Jun. 24, 1988 [DE] Fed. Rep. of Germany ..... 3821437

[51] Int. Cl.[5] ..... F04B 23/14

[52] U.S. Cl. ..... 417/69; 417/201

[58] Field of Search ..... 417/201-205, 417/69, 68, 67; 418/83; 415/55.1

[56] References Cited

U.S. PATENT DOCUMENTS

| | | | |
|---|---|---|---|
| 2,936,107 | 5/1960 | Blackburn | 230/45 |
| 3,642,384 | 2/1972 | Huse | 417/205 |
| 3,677,664 | 7/1972 | Wycliffe | 717/310 |
| 3,922,110 | 11/1975 | Huse | 417/2 |
| 3,956,072 | 5/1976 | Huse | 202/177 |
| 4,090,815 | 5/1978 | Nakamura | 417/203 |
| 4,225,288 | 9/1980 | Mugele et al. | 417/2 |
| 4,257,749 | 3/1981 | Ramm | 417/68 |
| 4,588,358 | 5/1986 | Rietschle | 418/83 |
| 4,789,314 | 12/1988 | Higuchi | 417/243 |
| 5,020,969 | 6/1991 | Mase | 415/55.1 |
| 5,040,949 | 8/1991 | Crinquette | 417/205 |

FOREIGN PATENT DOCUMENTS

| | | |
|---|---|---|
| 0447716 | 9/1991 | European Pat. Off. . |
| 0414133 | 5/1925 | Fed. Rep. of Germany . |
| 2138383 | 3/1973 | Fed. Rep. of Germany . |
| 8427615 | 1/1985 | Fed. Rep. of Germany . |
| 3545982 | 2/1987 | Fed. Rep. of Germany . |
| 2276487 | 1/1976 | France . |
| 2346580 | 10/1977 | France . |

OTHER PUBLICATIONS

Maschinenmarkt, Vogel-Verlag Würzburg, vol. 88, No. 17, Mar. 2, 1982: "Auswahlkriterien für Pumpen zum Erzeugen von Vakuum" by Michael Rannow.

*Primary Examiner*—Richard A. Bertsch
*Assistant Examiner*—Peter Korytnyk
*Attorney, Agent, or Firm*—Kenyon & Kenyon

[57] ABSTRACT

A multi-stage vacuum pump installation having an oil-lubricated or dry-running mechanical displacement pump located in the atmospheric stage. The oil-lubricated or dry-running pump is preceded on the vacuum side by at least one additional pump which is a side channel compressor pump (or gas ring pump). A side channel compressor pump located upstream of the oil-lubricated or dry-running pump reduces oil consumption and at the same time improves efficiency of the installation.

20 Claims, 2 Drawing Sheets

MULTI-STAGE VACUUM PUMP INSTALLATION

BACKGROUND OF THE INVENTION

The invention relates generally to a multi-stage vacuum pump installation and, more particularly, to an installation which has an oil-lubricated or dry-running mechanical displacement pump in the final atmospheric stage. The installation also has at least one additional pump located in the vacuum side which is connected to the oil-lubricated or dry-running mechanical displacement type pump.

The efficiency of mechanical displacement pumps in the entire vacuum range is known. DE-OS 35 45 982 and DE-GM 84 27 615 disclose multi-stage vacuum pump installations containing several rotary vane pumps in series. Because such pumps generally require oil as a lubricating and sealing medium, new oil must be continuously supplied in all stages of the installation. Although the supplied amounts of oil are relatively small, the constant or controlled supply of fresh oil is a considerable cost factor. Additionally, the spent oil must first be removed from the transported medium by independent separators and then eliminated.

A multi-stage vacuum pump installation that contains a Roots pump located upstream and connected to a rotary vane pump is disclosed in "Criteria for pump selection for the creation of a vacuum","Maschinenmarkt", vol. 88, No. 17, Mar. 2, 1982, published by Vogel-Verlag Wurzburg. The pistons of Roots pumps rotate contactless and thus Roots pumps are efficient and superior to other mechanical vacuum pumps. Improved overall efficiency of a multi-stage vacuum pump installation can be achieved by placing a Roots pump upstream in the installation. The improved efficiency of multi-stage installations using Roots pumps is only possible for pressure differences of less than 50 mbar. The many narrow gaps of Roots pumps do not permit greater pressure differences because the greater temperature rise connected with higher pressure differences causes thermal expansions which, due to the narrow gaps, may readily lead to jamming of the pistons.

A greater pressure difference in an installation could be obtained without the danger of piston jamming by intensive cooling of the installation or by connecting several Roots pumps in series. However, intensive cooling or series connection would dramatically increase the construction and maintenance cost of the installation. Additionally, the safety of operation would be impaired.

An installation for high vacuum ranges that contains a molecular pump and an oil-sealed rotary pump is disclosed in U.S. Pat. No. 4,090,815. Oil-sealed rotary pumps are used in vacuum engineering for pressure ranges from 1013 mb (760 Torr) to a maximum of $10^{-4}$ mbar (about $10^{-4}$ Torr). Because oil-sealed rotary pumps are unable to produce a high vacuum, usually the oil-sealed rotary pump is preceded in the installation by a molecular pump. Molecular pumps operate on the principle of pulse transmission at solid faces. The molecular pump of the 4,090,815 patent has a rotating circular disk for its pulse transmission that is rotatably mounted in a two-part housing. Each housing part has a spiral delivery groove whose cross-section tapers in the direction of increasing pressure, which corresponds to increasing molecular density. Each of the delivery grooves and the rotating circular disk form a working channel. The rotating disk constitutes the moving wall of the working channel on to which the molecules impinge. Due to the rotation of the disk, a drift velocity is superposed on the isotropic velocity distribution (corresponding to the wall temperature) of the individual gas molecules. This results in flow of the gas molecules and hence pumping occurs.

The present invention is directed to the problem of further developing an installation of the general type described above which decreases oil consumption, thus decreasing the amount of dirty oil, and increases efficiency when compared to known multi-stage vacuum pump installations.

SUMMARY OF THE INVENTION

The present invention solves this problem by providing a multi-stage vacuum pump installation having an oil-lubricated or dry-running mechanical displacement pump located in the atmospheric stage and a gas ring pump (side channel ring compressor) located in the vacuum stage, upstream of the oil-lubricated or dry-running mechanical displacement pump.

Thus, in the installation of the present invention, the upstream vacuum stage pump is a side channel compressor pump. Although a side channel compressor pump is only about half as efficient as a Roots pump, it has been demonstrated by tests that using a side channel compressor pump in a multi-stage vacuum pump installation reduces energy requirements as well as cost, without reducing the operating safety of the installation. Because side channel compressor pumps operate oil-free in their compression chamber, the amount of oil required for the installation is lower compared to an installation which has a mechanical displacement pump instead of the side channel compressor pump. Additionally, because a higher pressure ratio is attainable with a side channel compressor pump, the overall size of the downstream displacement pump is reduced. Smaller pumps require less lubricating oil, thus the energy requirement of the installation decreases. Cooling the medium compressed by the side channel compressor pump and/or cooling the side channel compressor pump also reduces the amount of lubricating oil required for the installation.

The side channel compressor pump is effectively cooled by jacket cooling. Jacket cooling is achieved by providing cooling channels at the housing of the side channel compressor pump. These cooling channels are connected to a circuit in which a cooling medium circulates. Because the side channel compressor pump is also connected to a cooling medium circuit of the rotary vane pump, only one cooler or heat exchanger is necessary for the installation.

A substantial saving of space and material is achieved by directly connecting the cooling medium paths of the side channel compressor and rotary vane pumps.

It is possible to optimally adapt the speed of each pump to existing operating conditions by coupling each pump to a separate drive motor. The drive motor is optionally speed adjustable. When a single drive motor is used for both pumps, the different operating speeds that may be necessary for optimum adaptation of both pumps can be obtained by coupling one of the two pumps directly with the drive motor, while coupling the other pump with the motor via a belt drive or a gearing.

DETAILED DESCRIPTION

Figure 1:
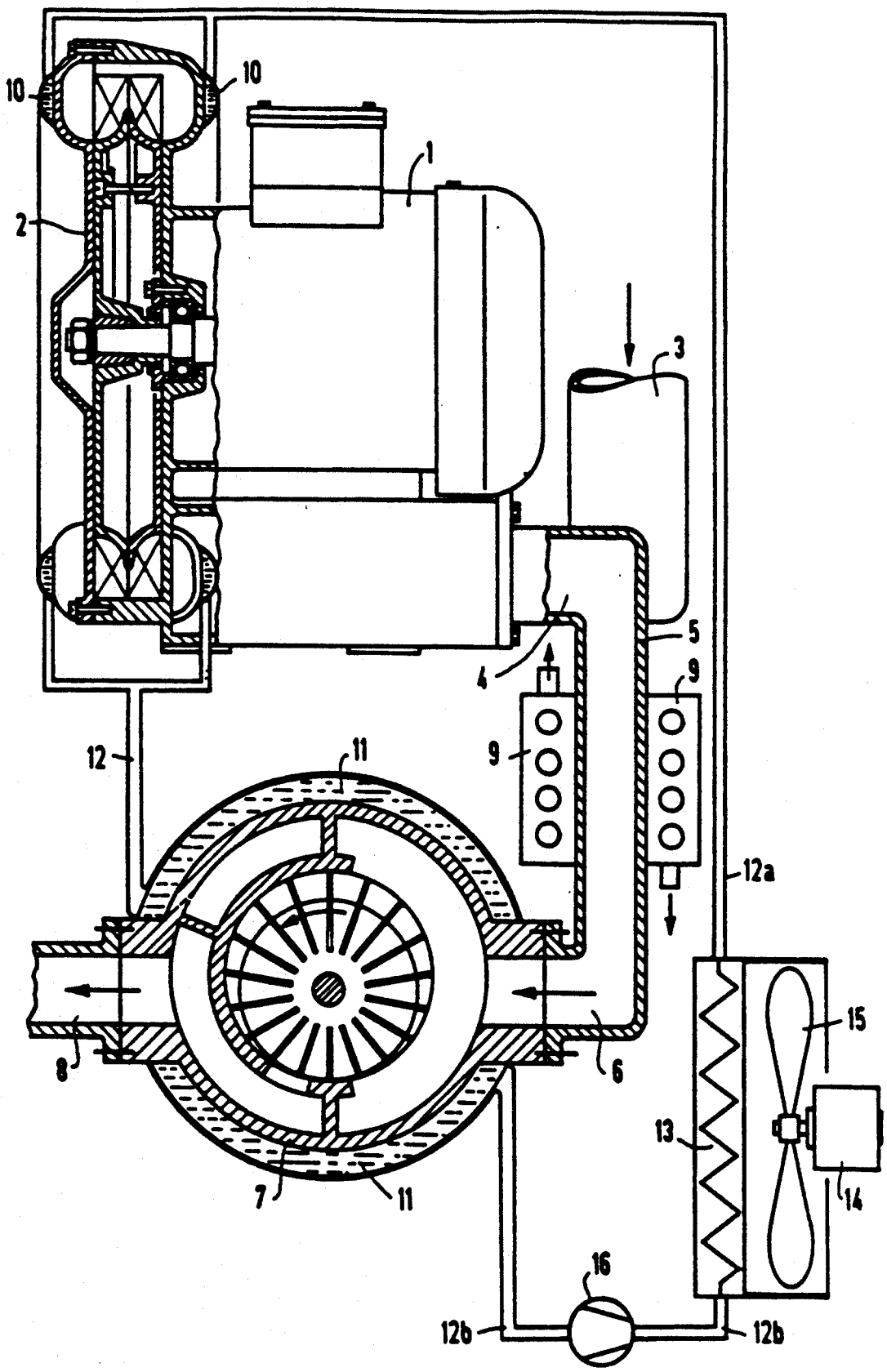
FIG. 1 is a schematic drawing of a multi-stage vacuum pump installation constructed according to the principles of the present invention.

FIG. 1 illustrates a gas ring pump (side channel compressor), driven by its own electric motor 1, has a suction pipe 3, through which the side channel compressor pump 2 is connected to a vessel (not shown in the drawing) to be evacuated. The side channel compressor pump 2 is connected by an outlet 4 to a connecting pipe 5 that leads to an inlet opening 6 of a rotary vane pump 7. The medium precompressed by the side channel compressor pump 2 is compressed further by the rotary vane pump 7 and then ejected via the outlet opening 8.

The size of the rotary vane pump compressing to atmosphere can be considerably smaller due to the presence of a side channel compressor pump 2 upstream of a rotary vane pump 7. This type of installation requires substantially less lubricating oil as compared with a multi-stage vacuum pump group consisting only of rotary vane-pumps because the medium is precompressed by the gas ring pump 2, and the rotary vane pump 7 is smaller. Because the side channel pump 2 operates completely oil-free in its compression chamber, the amount of oil otherwise necessary for the preliminary stage is eliminated. Additionally, a side channel compressor pump 2 having a single shaft and no gears can be constructed in multi-stage design cost-effectively so that a great pressure difference, i.e., a high precompression, is achievable.

A side channel compressor pump is substantially less sensitive as compared with Roots pumps because of the two to three times larger gaps in a side channel compressor pump. The gap losses in a multi-stage installation having a side channel compressor pump are neither greater nor smaller due to distribution over several stages. Furthermore, because side channel compressor pumps have freely rotating impellers, they are limited in permissible operating speed only by the type of the material used for the impeller. In a multi-stage installation using a side channel compressor pump, an especially good and intensive cooling can be achieved due to the larger surface as compared with an installation having instead a Roots pump. The intensive cooling contributes to an improvement in efficiency of the installation.

It has further been noted that for suction pressures under 20 mbar the energy and cooling water requirements of installations having a side channel compressor pump decrease considerably when compared to other installations not having a side channel compressor pump.

Cooling the medium conveyed by the side channel compressor pump 2 further reduces the amount of lubricating oil required in the downstream rotary vane pump 7. It is also possible to provide an intercooler 9 between the side channel compressor pump 2 and the rotary vane pump 7. The transported precompressed medium is cooled in the intercooler 9.

Additionally, injection cooling may be used in the installation of the present invention. In injection, cooling, a cooling medium is injected into the side channel compressor pump 2. Due to the cooling, the volume of medium to be compressed by the downstream rotary vane pump 7 is reduced. Thus, the downstream rotary vane pump 7 can be constructed smaller.

The medium to be compressed can be intensively cooled by jacket cooling the side channel compressor pump 2. Jacket cooling is achieved by forming cooling channels 10, which are transversed by a, cooling fluid, at the housing of the side channel compressor pump 2. The cooling channels 10 of pump 2 are connected via tubes 12 with a cooling jacket 11 of the rotary vane pump 7. The cooling jacket 11 of the rotary vane pump 7 is likewise traversed by cooling fluid. The cooling channels 10 of the side channel compressor pump 2 are connected via an additional conduit 12*a* with a cooler 13, and the cooling jacket 11 of the rotary vane pump 7 is connected via a conduit 12*b* to the other connection of cooler 13. The cooler 13 has a fan 15 driven by an electric motor 14. A circulating pump 16 may be arranged in the line of the conduits 12*a*, 12*b*.

In one embodiment of the present invention, the cooling medium circuits of the two pumps 2 and 7 are connected in series. Alternatively, these cooling medium circuits may be connected in parallel. In either case, one cooler for both pumps 2 and 7 is sufficient, thus reducing the construction cost of the installation.

Jacket cooling the side channel compressor pump 2 eliminates the need for the intercooler 9. Reducing the cost of material is also possible by connecting the inlet opening 6 of the rotary vane pump 7 directly to the outlet 4 of the side channel compressor pump 2. This type of connection results in a compact construction of the compressor installation.

Equiping each of the two pumps 2 and 7 with its own drive motor allows for optimum energy control because the speed of each pump can be optimally regulated. Optimum operation of the side channel compressor pump 2 is ensured by regulating the speed of its electric motor 1 such that the current consumption remains constant in the entire speed range.

In conjunction with the drawing figure, it will be appreciated that a drive motor may be coupled to either the side channel compressor pump or the mechanical displacement pump, wherein one of the pumps is coupled directly to the drive motor and the other pump is coupled to the motor by a coupling means. It will be appreciated further by those of ordinary skill in the art that various coupling means are available, one of which is a belt drive.

The present invention detailed in the figure may further comprise a shaft coupled to a drive motor, wherein the mechanical displacement pump and the side channel compressor pump further comprise an impeller, and wherein the impeller is attached to the shaft that is coupled to the drive motor.

Figure 2:
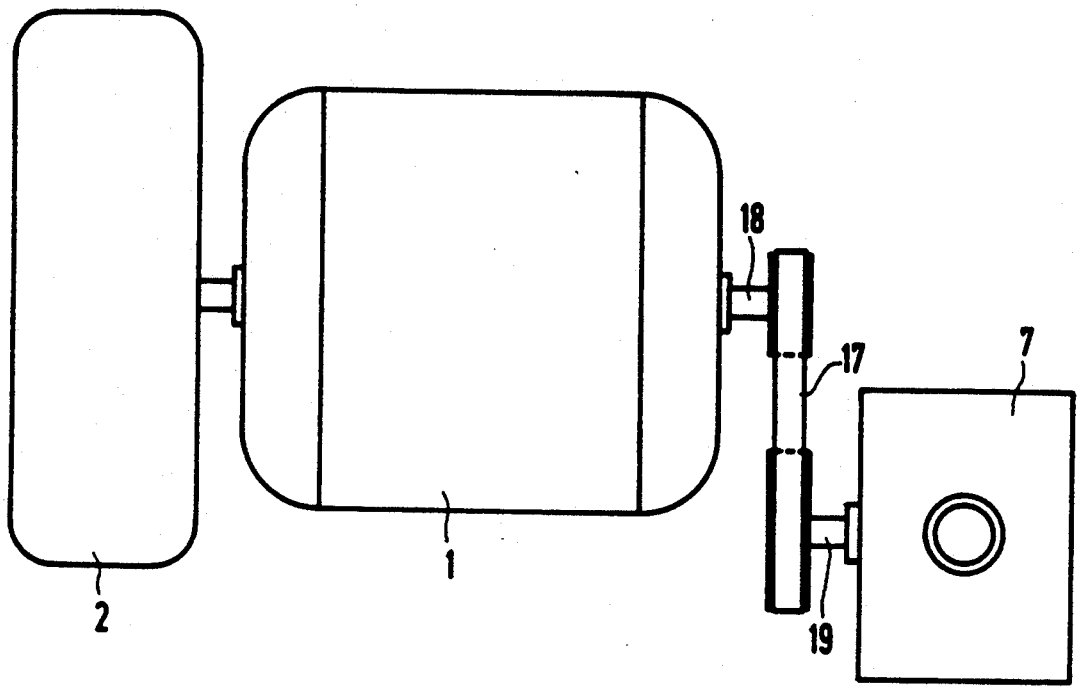
FIG. 2 illustrates an arrangement according to the present invention in which the side channel compressor pump is coupled directly to a drive motor and the mechanical displacement pump is coupled to the motor via a belt drive.

As illustrated in FIG. 2, side channel compressor pump 2 is directly coupled to one shaft end of electric motor 1. Rotary vane pump 7 is driven by the other shaft end 18 of electric motor 1 via a belt drive 17. Belt drive 17 drives a shaft 19 of rotary vane pump 7.

Figure 3:
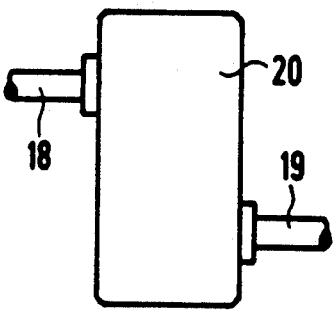
FIG. 3 illustrates an alternative coupling arrangement in which a gear replaces the belt drive of FIG. 2.

FIG. 3 illustrates a coupling arrangement which is an alternative to the belt drive 17 coupling arrangement illustrated in FIG. 2. A gear 20 may be coupled at an input side thereof to shaft end 18 of electric motor 1 and at an output side thereof to shaft 19 of rotary vane pump 7.

What is claimed is:

1. A multi-stage vacuum pump installation comprising:

a) a mechanical displacement pump located in the atmosphere stage; and b) a side channel compressor pump located in the vacuum stage and connected upstream to said mechanical displacement pump.

2. The installation according to claim 1 wherein said mechanical displacement pump is an oil-lubricated pump.

3. The installation according to claim 1 wherein said mechanical displacement pump is a dry-running pump.

4. The installation according to claim 1 further comprising an intercooler, wherein said intercooler is connected between said side channel compressor pump and said mechanical displacement pump.

5. The installation according to claim 4 further comprising a drive motor coupled to said side channel compressor pump and another drive motor coupled to said mechanical displacement pump.

6. The installation of claim 5 further comprising means for coupling one of said drive motors to either said side channel compressor pump or said mechanical displacement pump, wherein one of said side channel compressor pump and said mechanical displacement pump is coupled directly to said drive motor and another of said side channel compressor pump and said mechanical displacement pump is coupled to said motor by said coupling means.

7. The installation according to claim 1 wherein said side channel compressor pump is injected with a cooling medium.

8. The installation according to claim 7 further comprising a drive motor coupled to said side channel compressor pump and another drive motor coupled to said mechanical displacement pump.

9. The installation according to claim 1 wherein said side channel compressor pump comprises a housing having cooling channels formed thereto and a cooling medium circuit, wherein said cooling channels are connected to said cooling medium circuit.

10. The installation according to claim 9 wherein said mechanical displacement pump is a rotary vane pump comprising a cooling medium circuit.

11. The installation according to claim 10 wherein said cooling medium circuit of said side channel compressor pump and said cooling medium circuit of said rotary vane pump are directly connected together.

12. The installation according to claim 11 further comprising a drive motor coupled to said side channel compressor pump and another drive motor coupled to said mechanical displacement pump.

13. The installation according to claim 1 further comprising a drive motor coupled to said side channel compressor pump and another drive motor coupled to said mechanical displacement pump.

14. The installation according to claim 13 further comprising means for coupling one of said drive motors to either said side channel compressor pump or said mechanical displacement pump, wherein one of said side channel compressor pump and said mechanical displacement pump is coupled directly to said drive motor and another of said side channel compressor pump and said mechanical displacement pump is coupled to said motor by said coupling means.

15. The installation according to claim 14 wherein said coupling means is a belt drive.

16. The installation according to claim 14 wherein said coupling means is a gearing.

17. The installation according to claim 14 wherein said drive motors have controllable speed.

18. The installation according to claim 17 further comprising a shaft coupled to one of said drive motors and wherein said side channel compressor pump and said mechanical displacement pump further comprise an impeller, and wherein said impellers are positioned on a shaft.

19. The installation according to claim 13 wherein said drive motors have controllable speed.

20. The installation according to claim 19 further comprising a shaft coupled to one of said drive motors and wherein said side channel compressor pump and said mechanical displacement pump further comprise an impeller, and wherein said impellers are positioned on a shaft.

* * * * *